US006398564B1

(12) United States Patent
Wong

(10) Patent No.: US 6,398,564 B1
(45) Date of Patent: Jun. 4, 2002

(54) COMMUNICATION CONNECTOR FOR COMPACT COMPUTER DEVICES

(75) Inventor: Margaret Wong, Richmond, CA (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/416,095

(22) Filed: Oct. 12, 1999

(51) Int. Cl.[7] ..... H01R 13/44
(52) U.S. Cl. ..... 439/131; 439/676
(58) Field of Search ..... 439/131, 676, 439/344, 144, 946, 586, 538

(56) References Cited

U.S. PATENT DOCUMENTS

| | | | | |
|---|---|---|---|---|
| 1,989,823 | A | 2/1935 | Raabe | 173/328 |
| 3,433,886 | A | 3/1969 | Myers | 174/57 |
| 3,553,635 | A | 1/1971 | Lundergan et al. | |
| 3,613,043 | A | 10/1971 | Scheller et al. | |
| 3,622,684 | A | 11/1971 | Press | 174/48 |
| 3,685,002 | A | 8/1972 | Kennedy | |
| 3,777,303 | A | 12/1973 | McDonough | |
| 3,794,956 | A | 2/1974 | Dubreuil | |
| 4,047,781 | A | 9/1977 | DeNigris et al. | |
| 4,059,321 | A | 11/1977 | Rasmussen et al. | |
| 4,109,295 | A | 8/1978 | Rostek et al. | 361/401 |
| 4,482,938 | A | 11/1984 | Norden | 361/426 |
| 4,497,526 | A | 2/1985 | Myers | |
| 4,511,198 | A | 4/1985 | Mitchell et al. | |
| 4,603,229 | A | 7/1986 | Menchetti | 174/48 |
| 4,648,682 | A | 3/1987 | Tubbs | |
| 4,758,168 | A | 7/1988 | Awakowicz et al. | 439/83 |
| 4,809,360 | A | 2/1989 | Kraft | 455/603 |
| 4,878,848 | A | 11/1989 | Ingalsbe | 439/76 |
| 4,915,655 | A | 4/1990 | Tanaka | 439/676 |
| 4,954,928 | A | 9/1990 | Jullien | 361/391 |
| 4,968,260 | A | 11/1990 | Ingalsbe | 439/76 |
| 4,969,830 | A | 11/1990 | Daly et al. | 439/136 |
| 4,984,982 | A | 1/1991 | Brownlie et al. | 439/131 |
| 4,986,762 | A | 1/1991 | Keith | 439/131 |
| 4,993,962 | A | 2/1991 | Noda et al. | 439/136 |
| 4,997,381 | A | 3/1991 | Oh | 439/172 |

(List continued on next page.)

FOREIGN PATENT DOCUMENTS

| | | | |
|---|---|---|---|
| CA | 2101354 | 1/1994 | H01R/13/639 |
| CA | 2103514 | 2/1994 | H01R/17/18 |
| DE | 1 195 385 | 6/1965 | H02F/21/20 |
| EP | 0 355 413 | 7/1989 | H01R/13/44 |
| JP | 64-10585 | 1/1989 | H01R/13/46 |
| JP | 1-96055 | 4/1989 | C04B/35/00 |
| JP | 1-97652 | 4/1989 | B41J/3/00 |
| JP | 2-162667 | 6/1989 | H01R/13/33 |
| JP | 1-243384 | 9/1989 | H01R/9/11 |
| JP | 2-90481 | 3/1990 | H01R/17/04 |
| JP | 3-36477 | 2/1991 | F25D/11/02 |
| JP | 3-262069 | 11/1991 | G06F/15/02 |
| JP | 3-292519 | 12/1991 | G06F/1/16 |
| JP | 4-10748 | 1/1992 | H04M/11/00 |
| JP | 4-51761 | 2/1992 | H04M/11/00 |
| JP | 5-2923 | 1/1993 | H01B/7/02 |
| JP | 5-229344 | 9/1993 | B60J/5/04 |
| JP | 6-1658 | 1/1994 | C04B/35/52 |
| JP | 6-1659 | 1/1994 | C04B/35/52 |
| JP | 6-278656 | 10/1994 | B62D/25/10 |

*Primary Examiner*—Brian Sircus
*Assistant Examiner*—J. F. Duverne
(74) *Attorney, Agent, or Firm*—McDonnell Boehnen Hulbert & Berghoff

(57) ABSTRACT

A connector is provided for mating to a communication connector, where the communication connector includes a plurality of connector elements extending on at least a first side. The connector comprises a platform and a receptacle structure that is moveably coupled to the platform to move between a raised position and a lowered position. The receptacle structure includes an opening contoured to receive the communications connector when in the raised position. A connector surface includes a plurality of connector elements positioned on the platform to contact connector elements on the communication connector when the receptacle structure receives the communication connector.

15 Claims, 6 Drawing Sheets

U.S. PATENT DOCUMENTS 5,035,641 A 7/1991 Van-Santbrink et al. .... 439/329
5,035,649 A 7/1991 Collier et al. ..... 439/607
5,043,721 A 8/1991 May ..... 340/825.44
5,082,450 A 1/1992 Warren, Sr. et al. ..... 439/102
5,085,591 A 2/1992 Warren, Sr. et al. ..... 439/131
5,114,356 A 5/1992 Taybl et al. ..... 439/133
5,118,311 A * 6/1992 Margini ..... 439/676
5,122,069 A 6/1992 Brownlie et al. ..... 439/131
5,132,877 A 7/1992 Branan et al. ..... 361/395
5,159,533 A 10/1992 Kuang ..... 361/391
5,182,698 A 1/1993 Kobayashi et al. ..... 361/395
5,183,404 A 2/1993 Aldous et al. ..... 439/55
5,260,994 A 11/1993 Suffi ..... 379/399
5,285,014 A 2/1994 Gilchrist ..... 174/67
5,336,099 A 8/1994 Aldous et al. ..... 439/131
5,338,210 A 8/1994 Beckham et al. ..... 439/131
5,391,083 A 2/1995 Roebuck et al. ..... 439/76
5,391,094 A 2/1995 Kakinoki et al. ..... 439/638
5,395,268 A 3/1995 Okada ..... 439/676
5,411,405 A * 5/1995 McDaniels et al. ..... 439/131
5,463,261 A 10/1995 Skarda et al. ..... 307/131
5,477,418 A 12/1995 MacGregor et al. ..... 361/737
5,499,923 A 3/1996 Archibald et al. ..... 439/26
5,505,633 A 4/1996 Broadbent ..... 439/329
5,509,811 A 4/1996 Homic ..... 439/55
5,538,442 A 7/1996 Okada ..... 439/676
5,547,401 A 8/1996 Aldous et al. ..... 439/676
5,562,463 A 10/1996 Tan ..... 439/76.1
5,562,504 A 10/1996 Moshayedi ..... 439/638
5,608,607 A 3/1997 Dittmer ..... 361/686
5,634,802 A * 6/1997 Kerklaan ..... 439/131
5,637,018 A 6/1997 Gargiulo ..... 439/640
5,667,395 A 9/1997 Okada et al. ..... 439/131
5,679,013 A 10/1997 Matsunaga et al. ..... 439/144
5,692,914 A 12/1997 Mitani et al. ..... 439/131
5,754,404 A 5/1998 Biermann et al. ..... 361/737
5,773,332 A 6/1998 Glad ..... 439/344
5,775,951 A 7/1998 Gargiulo ..... 439/640
6,000,957 A * 12/1999 Betker et al. ..... 439/131
6,005,774 A * 12/1999 Chiba et al. ..... 439/676
6,142,834 A * 12/1999 Liao ..... 439/676

* cited by examiner

COMMUNICATION CONNECTOR FOR COMPACT COMPUTER DEVICES

BACKGROUND OF THE INVENTION

1. Field of the Invention

This invention relates to the field of connectors for computers and devices for computers. In particular, the invention relates to a connector for coupling a communication line to a computer.

2. Description of the Related Art

Communication plugs are used to establish communications between computers and other computers, local area networks and/or wide-area networks such as the Internet. In a typical application, computers connect to a phone jack having a RJ-style connector to access the Internet or an email server on a network.

Increasingly, more diverse and compact computers incorporate communication capabilities for communication lines using plug-style connectors. For example, computer devices including handheld computers, such as Palm Pilot™ organizers, laptop computers, and PCMCIA standard communication cards, may include RJ-style plugs for coupling the respective device to a phone or Ethernet line.

Some computing devices integrate a female connector to mate with a communication plug in a horizontal direction. For example, laptop computers often have a jack for receiving a RJ plug. Laptop computers usually include the jack on a side surface of the device. The thickness of a laptop computer is usually relatively small, causing the jack to be positioned close to the underlying surface in which the lap top computer rests on.

To minimize thickness, some computers such as the Sony VAIO™ computer employ a hinged female connector for mating to a communication plug. The hinged connector is accessible from a surface of the computer to receive a phone or Ethernet plug in a direction horizontal to the underlying surface that the computer rests on. The hinged extension is slanted with respect to the side of the computer so that the communication plug must be received at an angle.

In handheld devices, the exterior surface of the device is minimized to preserve size. Available surface space is often used to retain buttons for operating the device, a display screen, a microphone/speaker, and connectors for coupling the device to other computers and accessories. The thickness and compactness of the handheld computer is also an important design consideration.

PCMCIA cards are used to adapt certain computers for coupling with a communication line having a communication plug such an RJ-style plug. PCMCIA cards include Type I, Type II, and Type III cards. Type I and Type II cards in particular are constrained from incorporating a jack for a phone line because the relative size of such PCMCIA cards is mandated by industry standards to be less than 5 millimeters. Since RJ-style plugs are larger than 5 millimeters, these types of PCMCIA cards use additional adapters to couple to a RJ-style plug or Ethernet jack.

In particular, some PCMCIA cards for computers incorporate a connector as a retractable extension from a housing of the card. The connectors can be extended from the housing of the card to receive the RJ plug in a direction vertical to the planar dimensions of the PCMCIA card. This allows the computing device to incorporate the cross-sectional of the female RJ connector in a lateral direction, thereby minimizing exterior real estate needed for the female RJ connector. These devices are usually used with compact computers that have limited vertical dimensions.

SUMMARY OF THE INVENTION

A connector is provided to mate with communication plug that extends a communication line such as a phone line or Ethernet line. The connector is provided on a platform that is extendable from a surface of a housing that retains the connector. The connector also includes a receptacle structure that is moveably coupled to the platform. When the platform is extended, the receptacle structure may be raised to receive the communication plug in a horizontal direction with respect to the platform. When the connector is lowered, the platform can be retracted into the housing to be stored. Preferably, the connector is adapted to mate with a communication plug such as a RJ-11 or RJ-45 connector.

BRIEF DESCRIPTION OF THE FIGURES

FIG. 2A illustrates the receptacle structure is the lowered position with respect to the platform.

FIG. 2B is a close-up of FIG. 2A showing a coupling that moveable couples the receptacle structure to the platform, under an embodiment of the invention.

FIG. 2C is a close-up of FIG. 2B showing the coupling isolated from the connector, under an embodiment of the invention.

FIG. 4A illustrates one embodiment in which the platform may be extended from the housing, with a retracted position of the platform being shown in phantom.

FIG. 4B illustrates another embodiment in which the platform may be extended from or retracted into the housing.

DETAILED DESCRIPTION

Figure 1:
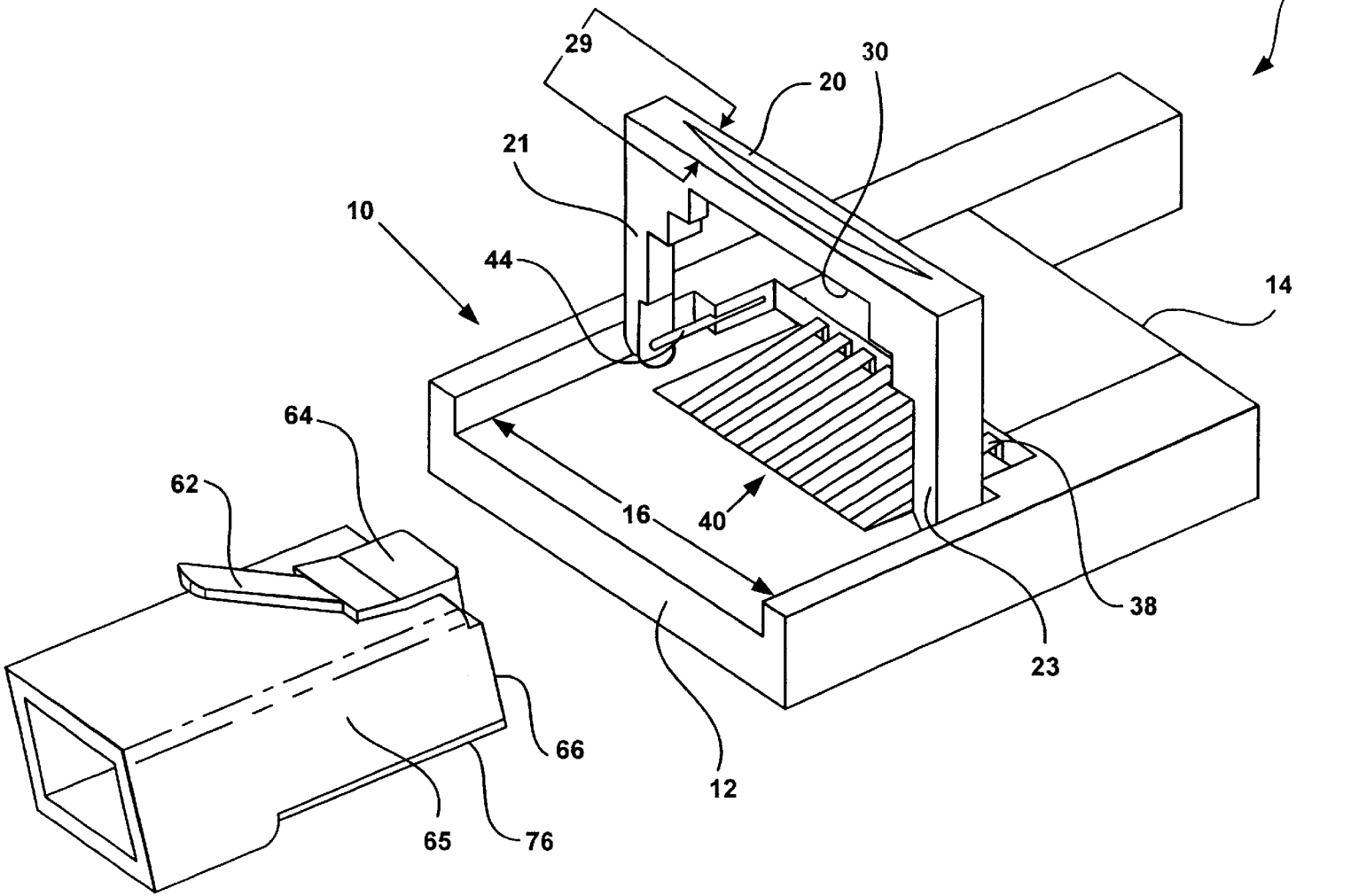
FIG. 1 is an isometric view of a connector having a platform aligned to receive a body of a communication connector that extends a communication line, with a receptacle structure being raised to receive the connector, under an embodiment of the invention.

Embodiments of the invention include a female connector for mating with a plug-type communication connector such as a RJ jack. A platform forms an extension of a computer or computer device to receive a communication plug. The connector includes a receptacle structure that is moveably coupled to the platform to move between a raised position and a lowered position. When the receptacle structure is raised, the plug-type communication connector may be received by and secured to the receptacle structure in a direction parallel to the platform. Connector elements on the connector are positioned on the platform to contact mating elements of the plug-type connector. When the receptacle structure is disengaged from the plug-type connector, the receptacle structure may be lowered towards the platform to reduce the size of the connector. In one embodiment, the connector may then be fitted into a housing of a device, such as a compact computer or a PCMCIA card.

Under an embodiment of the invention, the connector extends from and retracts into a housing of a device. When extended, the connector receives the plug-type connector in a horizontal direction with respect to the platform of the connector. Preferably, the plug-type connector can be inserted into the connector in a horizontal direction, while enabling the connector to be stored within a housing of the device as if it where aligned to receive the communication plug in a vertical direction. The orientation of the connector when stored minimizes a vertical thickness of the region in the housing dedicated to the connector. As a result, this embodiment can be employed in devices that have a relatively small vertical thickness, such as CompactFlash cards, thin lap top computers and handheld computers. The orientation of the connector enables the connector to be completely retracted into the housing of such devices until the connector is needed.

Previous connectors that couple computers to communication lines are usually fitted into a relatively cramped dimension of a computer. Typically, such computer either couple to the connector using a PCMCIA card, or include the connector as an integral component of the computer. In either case, computers extend known connectors in close proximity to an underlying surface of the computer. As a result, users are required to insert the communication plug vertically into the communication connector when the connector is in close proximity to the underlying surface. In these devices, the proximity of the underlying surface limits the clearence available for inserting the communication plug. The communication plug sometimes contacts the underlying surface prior to the communication plug being secured to the connector, resulting in a misconnection between the communication plug and the connector. In contrast, embodiments of the invention receive the communication plug horizontally with respect to the underlying surface, thereby avoiding the vertical clearance problem of previous devices.

In addition, these previous devices are susceptible to a user creating a moment that tilts the device and platform extension of the connector when the communication plug is inserted vertically into the connector. The applied moment sometimes results in the computer tilting and hitting the underlying surface prior to the connection between the communication plug and connector being made. These moments make inserting the communication plug more difficult to the user, sometimes even damaging the connector. Embodiments of the invention provide a connector that receives the communication plug in a direction horizontal to the underlying surface, thereby avoiding the creation of a moment that can tilt the computer or bend the platform of the connector.

Other devices including lap top computers such as the Sony VAIO™ use a hinged connector that can be extended from a side of the computer to receive a communication plug. However, the hinged connector includes a storage area within the housing having dimensions to accommodate an upright RJ-11 connector. In contrast, an embodiment of the invention allows for the connector to be folded into a non-upright or lateral position to be retracted into a housing of a computer or computer device. This allows the connector under an embodiment of the invention to be used with computer devices such as handheld computers, PCMCIA cards, and CompactFlash cards. In addition, the hinges on such devices are too mechanically intricate.

A. Detailed Description of Female Connector Under an Embodiment

FIG. 1 illustrates a female communication connector 100 for coupling a computer device to a communication line such as phone or Ethernet line. The communication connector 100 is adapted to receive an exterior body 65 of a communication plug 60 (shown in FIG. 4) that terminates the communication line. The connector 100 includes a platform 10 having a front end 12 for receiving the body 65 of the communication plug 60, and a back end 14. A recess 15 is positioned between the front end 12 and back end 14 and provides access to a pin block 40 having a plurality of connector elements 38. The connector 100 includes a receptacle structure 20, shown in a raised position and moveable to a lowered position (shown in FIG. 2). The receptacle structure 20 includes an opening 30 that is contoured to mate with a body 65 of the plug 60.

As shown, the receptacle structure 20 receives the body 65 of the communication plug 60 in a direction parallel or horizontal to the platform 10. This orientation coincides with the communication plug 60 being inserted horizontally with respect to an underlying surface of a computer or computer device housing the platform 10. Once received, connector elements 38 of the pin block 40 establish communications between the connector 100 and the communication plug 60.

As used herein, communication plugs include any connective device including an exterior body housing or retaining connector elements that inserts at least partially into a receptacle so that one or more connector elements can communicate with elements of an opposing connector. Communication plugs for use under an embodiment of the invention include known modular jack or media communication connectors, including RJ series connector such as an RJ-11 connector typically used with phone lines, 6-pin miniature modular plugs, 8-pin miniature modular plugs, and coaxial cables. The exterior body 65 of the plug 60 is shown in FIG. 1 to include a mating end 66 which fits into a recess 15 of the receptacle structure 20. The body 65 includes a spring member 62 that extends from a polarization structure 64 on the plug 60. The body 65 secures mechanically to a mating structure, such as provided by the receptacle structure 20, using the spring member 62 and the polarization structure 64.

A base of the connector 100, shown as the platform 10, forms an extension of a computer device. In an embodiment, the platform 10 is a retractable extension of computer device, including a printed circuit (PC) card having a PCMCIA architecture such as a Type II specification. In such applications, the platform 10 is dimensioned to have a thickness that is less than 5 millimeters so that the platform may be retracted back into the housing of the PCMCIA card.

Alternatively, the platform 10 may form a extension of a computer device such as a lap top computer or a handheld device. For example, the platform 10 may form a retractable extension of a Palm Pilot™, Palm III™, or Palm V™ organizer, manufactured by the 3 Com Corp., or of a Windows CE™ device such as a Nino™ personal companion, manufactured by the Philips Corp. Further description as to how the connector retracts into and out of a housing of a computer device such as a PCMCIA Type II card or computer housing is provided with FIGS. 4A and 4B.

In an embodiment, the platform 10 includes the recess 15 extending from the front end 12 of the platform 10 towards the back end 14. A width of the recess 15, illustrated by the directional arrow 16, is dimensioned to receive a horizontal contact surface 76 (see also FIG. 3) of the body 65. The pin block 40 is positioned within the recess 15 and includes a plurality of connector elements 38 for establishing an electrical connection to connector elements 67 (FIG. 3) on the plug 60. The pin block 40 is positioned within the recess 15 to contact the connector surface of the communication plug 60 when it is inserted through the receptacle 20. The recess 15 includes a width and a length corresponding to a dimension for frictionally receiving the bottom surface 67 of the external body 65. In specific applications, the recess 15 may include other contours or features to better receive the plug 60, such as a contour for another polarizing structure.

Figure 3:
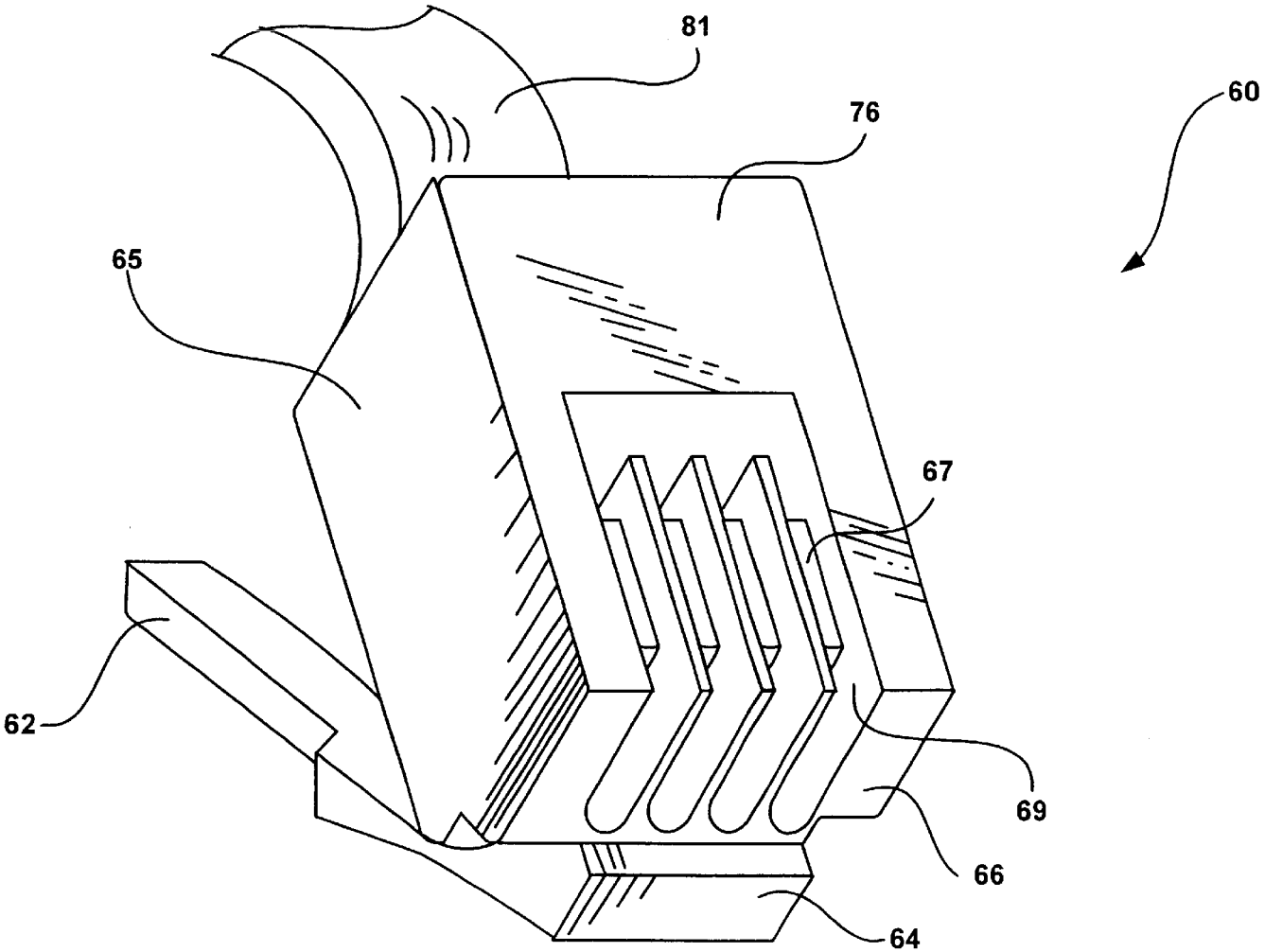
FIGURE 3 PRIOR ART
FIG. 3 illustrates a communication connector for extending a communication line to be coupled to a connector, under an embodiment of the invention.

The dimensions and features of the body 65, including its horizontal contact surface 76, depend on a particular type or make of the plug 60 (shown in FIG. 3). Preferably, the plurality of pin elements 38 forming the pin block 40 are dimensioned and spaced from one another to form an electrical connection with connector elements of an RJ-11 or RJ-45 type plug.

In an embodiment, receptacle structure 20 is pivotally coupled to the platform 10. The receptacle structure 20 is preferably coupled to the platform 10 within the recess 15 to move between a raised position (as shown in FIG. 1) and a lowered position (as shown in FIG. 2). In the raised position, the receptacle structure 20 is preferably vertical with respect to the platform 10, and the platform 10 is assumed to be parallel to an underlying surface of a device employing the connector 100. The opening 30 of the receptacle structure 20 is contoured to receive the body 65 when the receptacle structure 20 is in the raised position.

The dimensions and contours of the opening 30 are configured according to the type of communication plug 60 being received. For RJ series communication plugs as shown in FIGS. 1 and 3, the opening 30 includes features to align with and receive the polarization structure 64. The plug 60 may be passed through the opening 30 by depressing the spring member 62. A flare portion 63 of the spring member 62 obstructs against the receptacle structure 20 as the plug 60 is passed through the opening 30. The outward force caused by the flare portion 63 combines with the bias of the spring member 62 to retain the communication plug 60 within the receptacle structure 20 once a sufficient length of the body 65 is passed through the opening 30.

Once the body 65 is passed through the opening 30, connector elements on a bottom surface of the plug 60 electrically connect with the connector elements 38 forming the pin block 40. The connector elements 38 may be inclined with respect to the platform 10. Inclination of the connector elements 38 increases the effective wiping length as the connector elements of the communication plug 60 wipe across the pin block 40. The added length arising from inclining the connector elements 38 reduces the chance of a connection between any two mated connector elements failing.

A thickness of the receptacle structure 20 is defined by the directional arrow 29, shown in FIG. 1. In an embodiment, the thickness of the receptacle structure 20 is sufficiently small so that a portion of the communication plug 60 extends beyond the receptacle structure 20 towards the back end 14 of the platform 10, when the communication plug 60 has secured with the receptacle structure 20 to establish communications with the connector 100. The relatively small thickness of the receptacle structure 20 allows it to be folded towards the platform 10 when not in use.

With further reference to FIG. 1, the receptacle structure 20 is coupled to the platform 10 by a pair of laterally opposed couplings 44. Preferably, the couplings 44 are screwless, and comprise a bent member that extends into a portion of the platform 10 and the receptacle structure 20. Each coupling 44 then serves to pivotally couple a respective leg 21, 23 of the receptacle structure 20 to the platform 10.

In an embodiment, the couplings 44 include a torsional spring (not shown) to bias the receptacle structure in the raised position. In this way, the receptacle structure 20 may snap into the raised or lowered positions when the platform is exposed from a housing of a PC card or compact computer.

Figure 2B:
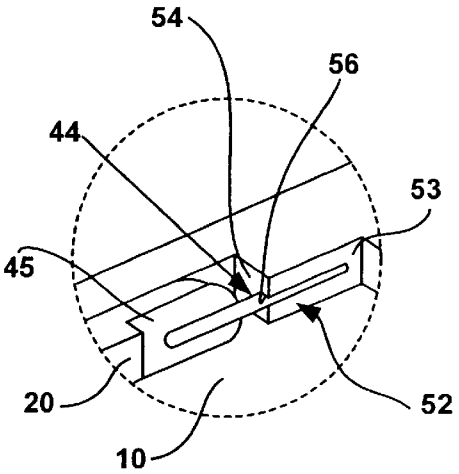
FIGS. 2A–2C illustrate the connector with the receptacle structure in a lowered position to be stored in a housing, under an embodiment of the invention.
Figure 2C:
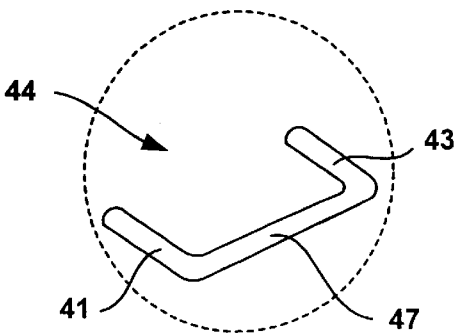
Figure 2A:
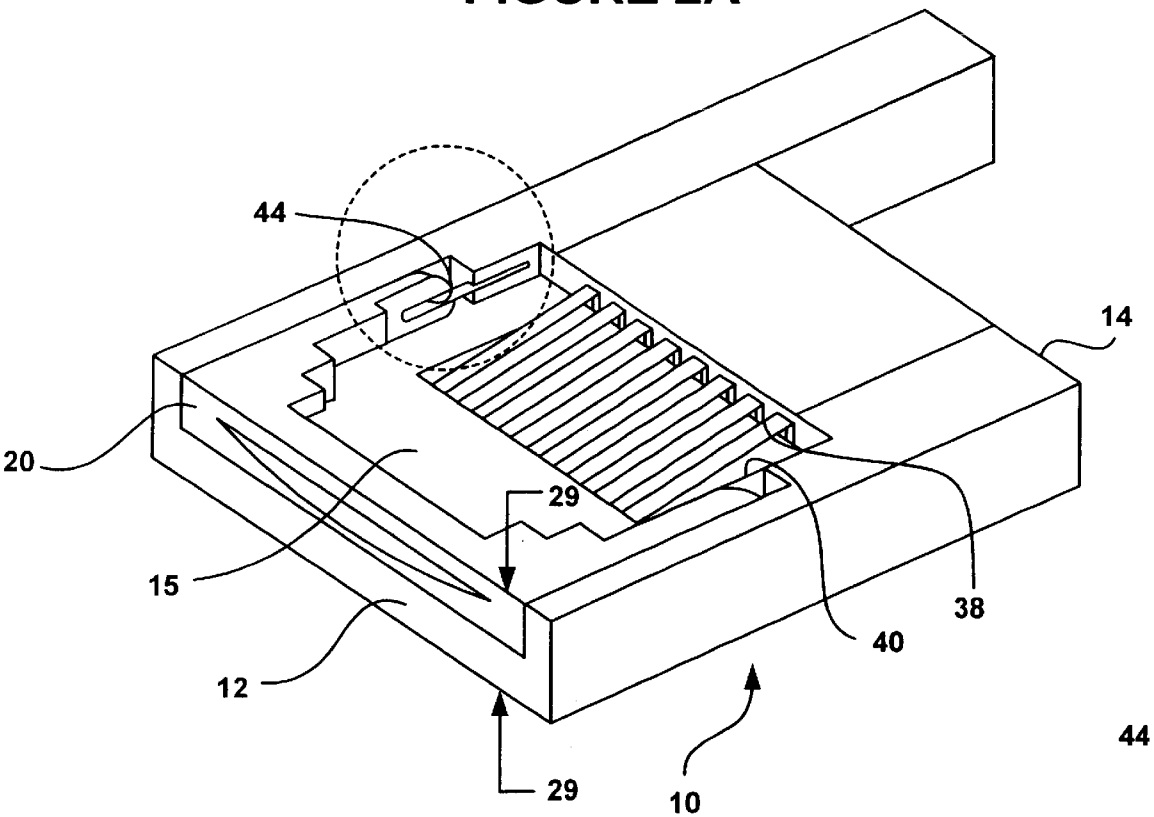

FIG. 2A illustrates the receptacle structure 20 in a lowered or horizontal position with respect to the platform 10. In an embodiment, the recess 15 is shaped to receive the receptacle structure 20 in the lowered position. Preferably, the width 16 (FIG. 2) of the recess is minimized to accommodate the receptacle structure 20 and the bottom surface of the communication plug 60.

In an embodiment, the receptacle structure 20 has a sufficiently thin thickness (shown by directional arrow 29) to enable it to be entirely contained in the recess 15 in the lowered position. When the receptacle structure 20 is in the lowered position, the thickness of the connector 100 is equivalent to the thickness of the platform 10. As a result, the vertical cross-section dedicated to storing the connector 100 may be minimized to enable devices such as PCMCIA Type II cards to store the connector within an internal chamber that is accessible from an edge or end of the card.

FIG. 2B provides a close-up of the coupling 44 pivotally connecting the receptacle structure 20 to the platform 10. The receptacle structure 20 includes a pair of rounded ends 45 that allow the receptacle structure 20 to pivot with respect to the platform 10 as the receptacle structure is moved between the raised and lowered positions. Each coupling 44 inserts into a corresponding rounded end 45 of the receptacle structure 20.

Contours towards a backend of the recess 15 form a pair of interference clutch structures 52 that oppose one another across the width 16 (FIG. 2A) of the recess 15 (FIG. 2A). Each interference clutch structure 52 is formed by two surfaces forming contours of a sidewall defining the recess 15. A first surface 53 extends length-wise between the front end 12 and back end 14, and a second surface 54 extends outward at ninety-degrees from the first surface 53. A slot 56 is accessible on the second side 54, and extends towards the back end 14. Preferably, a length of the slot 56 is also accessible on the first side 53 from the recess 15.

The couplings 44 couples the receptacle structure 20 to the platform 10 by extending into the respective interference clutch structure 52 of the platform 10. Each slot 56 on the interference clutch structure 52 is dimensioned to receive and retain the coupling 44. In this way, the interference clutch structure 52 on each end of the recess 15 serves to keep each coupling 44 from loosening and disassembling the receptacle structure.

FIG. 2C shows the coupling 44 removed from the connector 100. As shown, the coupling 44 includes a straight middle segment 47 that extends between the receptacle structure 20 and the platform 10. Each coupling 44 further includes a bent segment 41 that extends into the receptacle structure 20, and a bent segment 43 that extends into the platform 10 from within the slot 56 of the interference clutch 52. Preferably, a portion of the middle segment 47 for each coupling 44 extends into the slot 56 of the interference clutch structure 52 to allow the bent segment 43 to extend into the platform 10.

In an embodiment, each coupling 44 is formed from metal. The remainder of the connector 100, including the receptacle structure 20 and the platform 10 are formed from molded plastic. Preferably the receptacle structure 20 and the platform 10 are each separately formed units. The pin block 40 may be formed as a separate step when the platform 10 is molded. The receptacle structure 20 may then be assembled to pivotally connect to the platform 10 using the coupling 44. The coupling 44 can, for example, be snap-fitted into the receptacle structure 20 and platform 10 in an assembly step. In a subsequent assembly step, the receptacle structure 20 can be coupled to the platform 10.

In another example, the receptacle structure 20 can be positioned on the platform 10. The coupling 44 can then be snapped into the receptacle structure 20 and the platform 10 in one step, thereby coupling the receptacle structure 20 to the platform 10.

C. Description of Communication Plug and Device Housing Under an Embodiment

FIG. 3 illustrates the communication plug 60 with reference to an RJ-11 jack, under an embodiment of the invention. The body 65 of the communication plug 60 includes a front surface 66 that is received by the receptacle structure 20. The communication line 81 extends into the body 65. The communication line 81 may include, for example, a phone or network communication line. The horizontal contact surface 76 is received within the recess 15 of the platform 10. As shown, the horizontal contact surface 76 is preferably orthanormal to the front surface 66. The front surface 66 and the horizontal contact surface 76 each include slots 69 for retaining and isolating four connector elements 67.

The connector elements 67 contact and wipe across corresponding connector elements 38 of the pin block 40 on the platform 10. As illustrated by FIG. 3, the inclination of the contact elements 38 helps to create a better wiping motion as the contact elements 67 of the plug 60 are moved across corresponding contact elements 38 in conjunction with the motion of the plug 60 into the receptacle structure 20.

FIG. 3 shows a traditional alignment of the communication plug 60 when mating the communication plug 60 to, for example, a female RJ style connector in a computer or computer device. The horizontal contact surface 76 of the communication plug 60 is traditionally aligned to be a top surface when it is inserted into a mating structure. Under an embodiment of the invention, the receptacle structure 20 is aligned so that the body 65 is turned over with respect to the traditional alignment when inserted into the receptacle structure 20. That is, the horizontal contact surface 76 is oriented to be received by the receptacle structure 20 as a bottom surface of the body 65 by the receptacle structure 20. By adapting the receptacle structure to receive the communication plug 60 in this orientation, the receptacle structure 20 can be better dimensioned to conserve space on the platform 10.

Figure 4A:
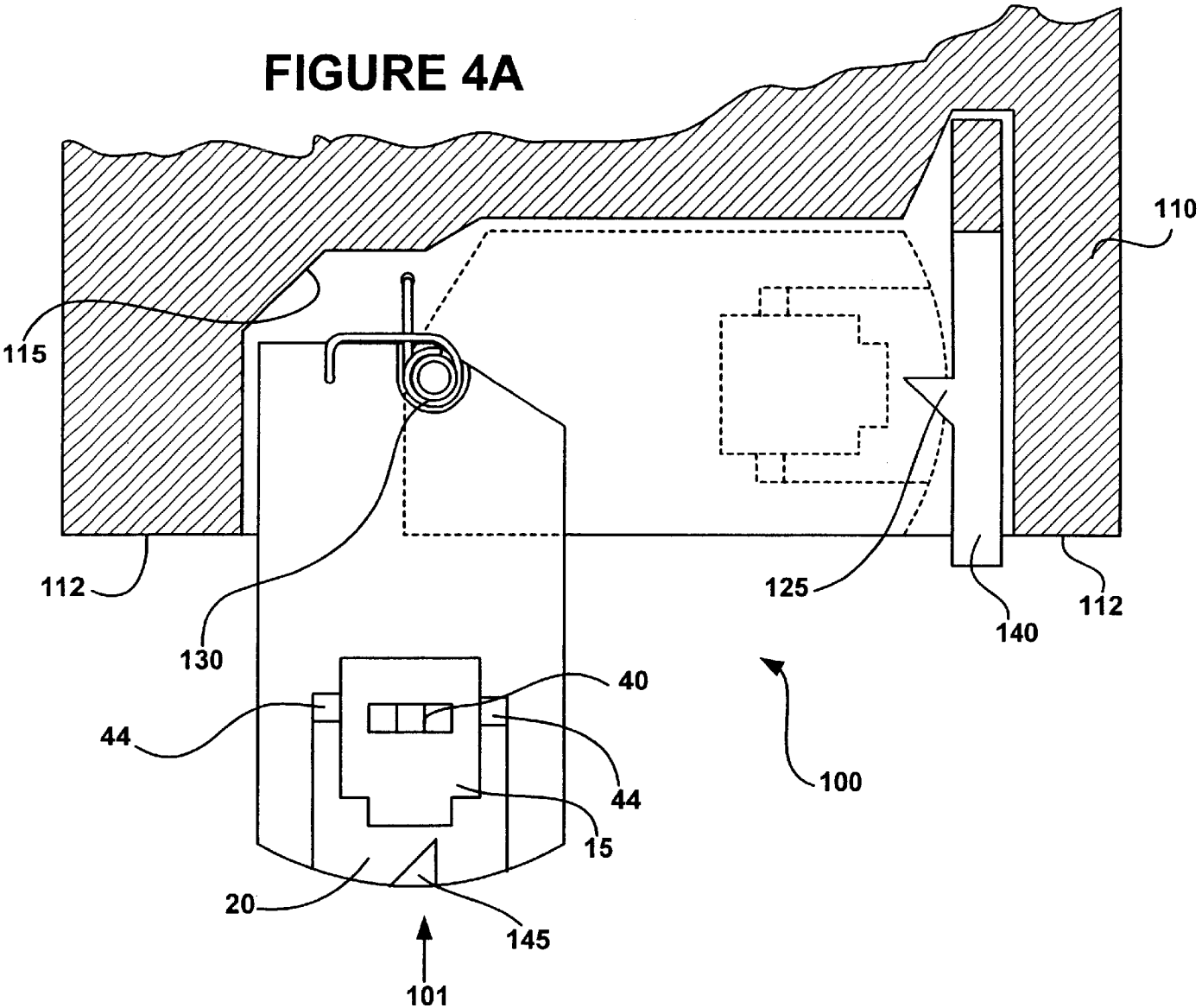
FIGS. 4A–4B illustrate a platform of the connector moveably coupled to a housing to extend and retract into the housing.

FIG. 4A illustrates an embodiment of the invention in which the platform 10 is coupled to retractably extend from a housing 110. In an embodiment, the housing 110 is a portion of a computer device, such as a lap top or handheld computer (see discussion accompanying FIG. 6). In another embodiment, the housing 110 forms a portion of a computer device such as a PCMCIA Type II card (see discussion accompanying FIG. 5). An accessory end of the PC card may be adapted to couple with the platform 10.

The platform 10 is coupled to the housing 110 through a torsional spring 130. The connector 100 includes a retracted position (shown in phantom) in which the platform 10 is retracted into a chamber 130 of the housing 110. In an extended position, the platform 10 is extended orthagonally to an edge 112 of the housing. Once in the extended position, the receptacle structure 20 (shown in the lowered position) may be lifted in a direction extending out of the paper to receive the communication plug 60. The communication plug 60 can then be directed in a horizontal direction with respect to the platform 10, shown in FIG. 5 by the arrow 101.

It should be noted that some computer devices such as certain types of PCMCIA cards include a housing having a portion that is rounded, or which otherwise is vertically extended outside of the computer when the device is coupled to the computer. As shown by the directional arrow 101, the communication plug 60 is entered in a direction 101 that is substantially parallel to a tangential plane of a portion housing of the PCMCIA card. The portion of the housing may be retained within the computer when the PCMCIA card is inserted into the computer. The directional arrow 101 is also parallel to with respect to the platform 10.

In the lowered position, the receptacle structure 20 may be pushed into the chamber 115 of the housing 110. A biased member 140 is preferably coupled to the interior of the housing 110 within the chamber 115. The biased member 140 includes a tooth 125 that extends into the chamber 115. To retract, the platform 10 is rotated towards the housing 110. This causes the torsional spring 130 to bias the platform 10 outward from the housing 110.

When the connector 100 is rotated into the housing 110, the platform 10 biasely pushes the tooth 125 inward until a notch 145 in the receptacle structure is caught by the tooth. The notch 145 may be located on either the receptacle structure 20 or the platform 10. Once the notch 145 is caught by the tooth 125, the connector 100 is secured within the chamber 115 of the housing 110.

Figure 4B:
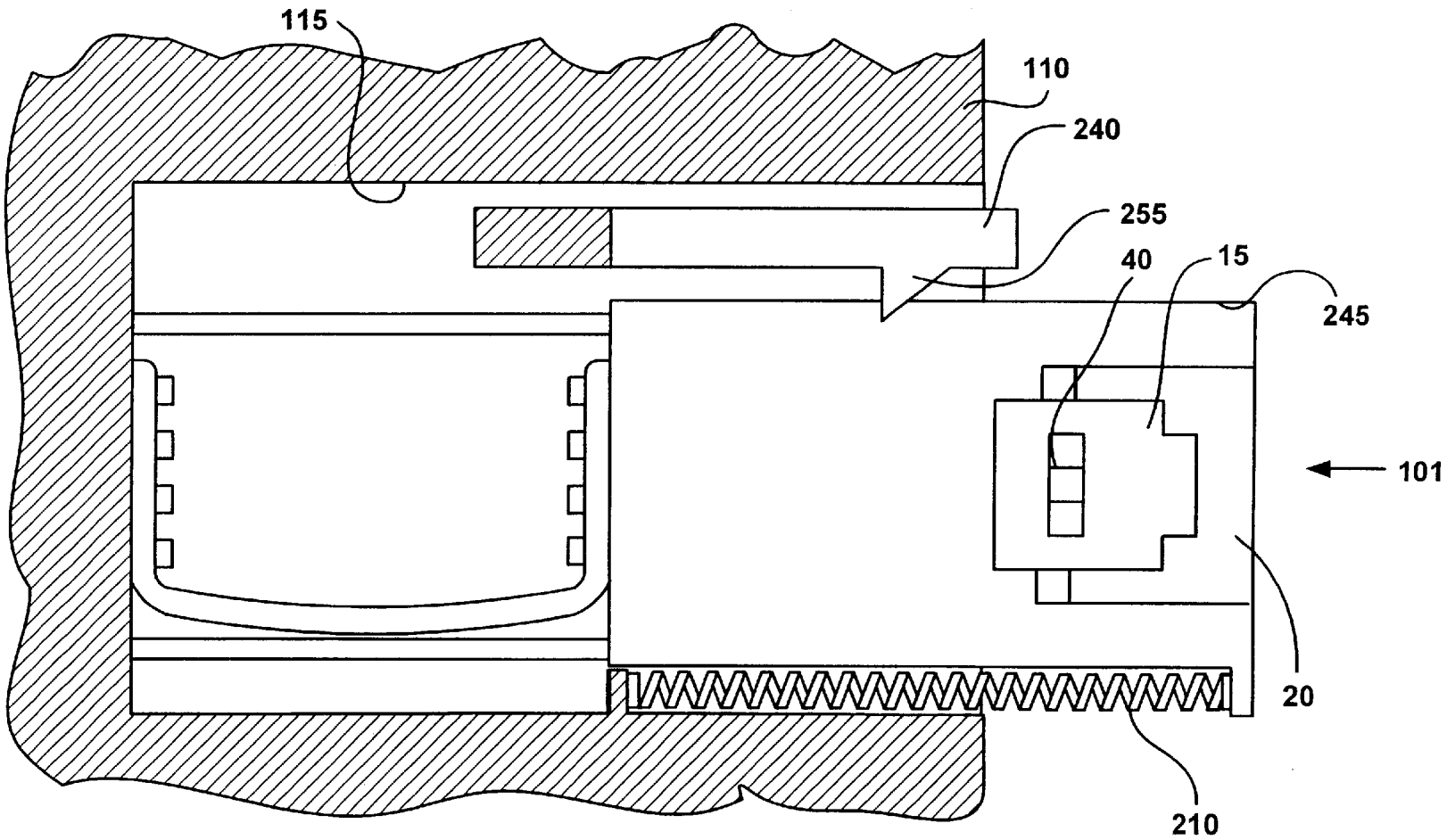

FIG. 4B illustrates another embodiment in which the connector 100 is retractable into the housing. The platform 10 may be coupled to the chamber 115. A catch member 240 extends longitudinally within the chamber 115, and includes a tilt that directs the catch member 240 into a side of the platform 10. A spring 210 is coupled to the platform at another side. The spring 210 biases when the connector 100 is pushed from an extended position (as shown) to a retracted position. In the extended position, the catch member 240 catches into a first notch 255 to prevent further movement of the connector 100 in a direction away from the housing 110.

In the retracted position, the connector 100 is pushed into the housing 110. The inward motion of the platform 10 biases the spring 210. When the connector 100 is fully inserted, the catch member 240 engages a second notch 245 to retain the platform 10. The connector 100 is retained within the housing 110 in a biased state.

The catch member 240 engages each notch 245, 255 through the use of a tooth 265. The tooth 265 includes a contoured surface that can be engaged by an inward motion of the platform 10 to force the catch member 240 against the housing 110 and away from the platform. In this way, the connector 100 need only be pushed inward by a user to disengage the catch member 240 from a notch and to allow the platform to be extended from a retracted position, or retracted from an extended position.

Several other embodiments may be used to extend the connector 100 from a housing of a computer or computer device. Examples of such alternative embodiments may be found in U.S. Pat. Nos. 5,773,332 and 5,816,832.

Figure 5:
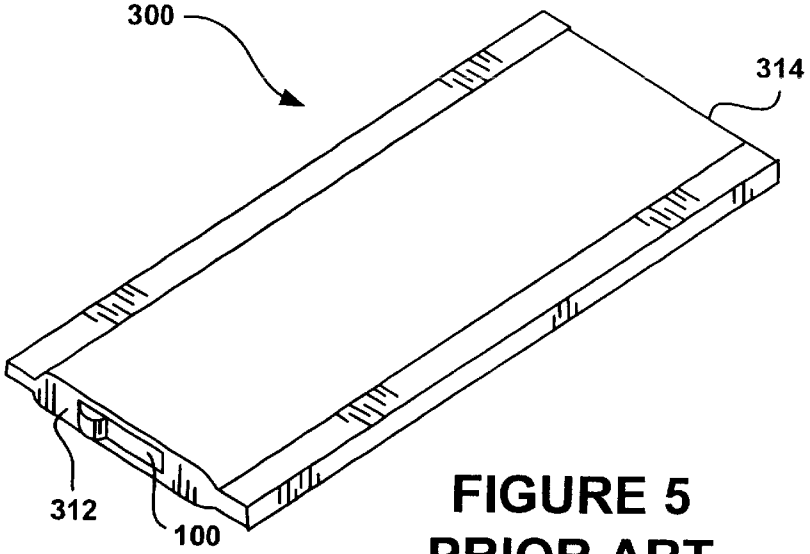
FIGURE 5 PRIOR ART
FIG. 5 illustrates a printed circuit card device, under an embodiment of the invention.

FIG. 5 shows a PCMCIA Type II card 300 for use with an embodiment of the invention. The thickness of the card 300 is less than 5 millimeters. As shown, an embodiment of the invention may be extended and retracted out of a front end 312 of the card 300. A back end 314 of the card mates with a connector within a PCMCIA slot of a computer.

Figure 6:
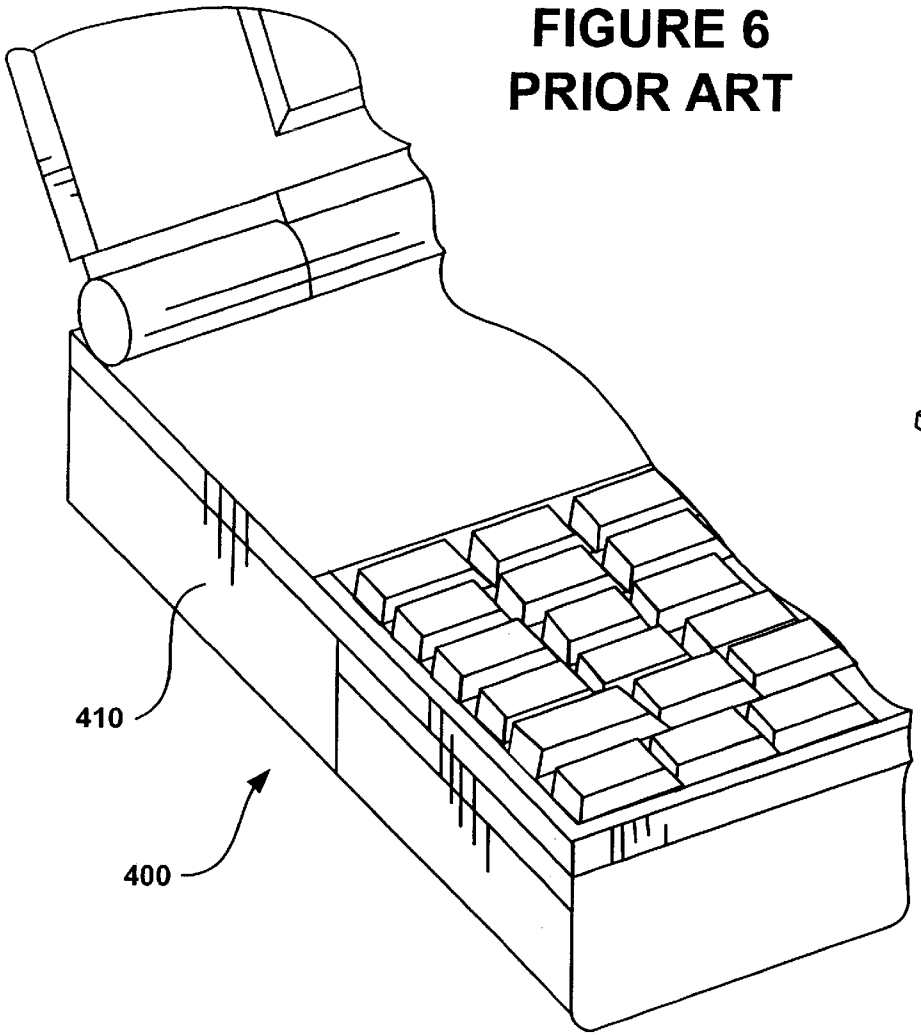
FIGURE 6 PRIOR ART
FIG. 6 illustrates a computer device, under an embodiment of the invention.

FIG. 6 shows a laptop computer 400 device for use with an embodiment of the invention. A side 410 of the laptop computer defines a thickness available for incorporating the connector 100. Embodiments such as shown by and described with FIGS. 4A and 4B may be incorporated into the side 410 to minimize the thickness of the computer 400, while enabling the computer to use communication lines without any external connectors and adapters.

C. Conclusion

The foregoing description of various embodiments of the invention has been presented for purposes of illustration and description. It is not intended to limit the invention to the precise forms disclosed. Many modifications and equivalent arrangements will be apparent.

What is claimed is:

1. A connector for mating to a communication connector, the communication connector including a plurality of connector elements extending on at least a first side, the connector comprising:

a platform having a recess of a first thickness, the recess having a bottom surface, the platform being of a second thickness, the first thickness being less than the second thickness;

a receptacle structure moveably coupled to the platform to move between a raised position and a lowered position, the receptacle structure including an opening contoured to receive the communications connector when in the raised position, a thickness of the receptacle structure being no more than the first thickness of the recess so that the receptacle structure is contained within the recess when in the lowered position, and a connector surface including a plurality of connect elements positioned on the platform to contact connector elements on the communication connector when the receptacle structure receives the communication connector.

2. The connector of claim 1, wherein the receptacle structure includes the opening contoured to be coupleable with an RJ style communication connector.

3. The connector of claim 1, wherein the communication connector includes a second surface orthanormal to the first surface, the plurality of connector elements extending on at least the first side and the second side of the communication connector, wherein the receptacle structure is aligned with the platform to receive and couple to the communication connector oriented so that the first surface is proximal and parallel to the platform as the communication connector is received by the receptacle structure from the second side.

4. The connector of claim 2, wherein the opening of the receptacle structure is contoured to receive a spring member for retaining the RJ style connector distally from the platform.

5. The connector of claim 1, wherein the receptacle structure is pivotally coupled to an interior portion of the platform by a coupling, the receptacle being pivotable with respect to the platform to extend between the vertical direction and the horizontal direction.

6. The connector of claim 5, wherein the coupling is a pin member including an elongated section, a first bent end section extending into the receptacle structure, and a second bent end section extending into the interior portion of the platform.

7. The connector of claim 1, wherein the receptacle is dimensioned so that a portion of the communications connector extends beyond the receptacle structure when the communications connector couples to the receptacle structure.

8. A connector for mating to a communication connector, the communication connector including a plurality of connector elements extending on at least a first side, the connector comprising:

a platform having a recess of a first thickness, the platform being of a second thickness the first thickness being less than the second thickness;

a receptacle structure including an opening contoured to receive the communication connector, a thickness of the receptacle structure being no more than the first thickness of the recess so that the receptacle structure is contained within the recess when in the lowered position;

a means for moveably coupling the receptacle structure to the platform to move the receptacle structure between a lowered position and a raised position to receive the communications connector; and a connector surface including a plurality of connector elements positioned on the platform to contact connector elements on the communication connector when the receptacle structure receives the communication connector.

9. A connector for mating to a communication connector, the communication connector including a plurality of connector elements extending on at least a first side, the connector comprising:

a platform, the platform forming a first clutch structure and a second clutch structure;

a receptacle structure including a first end and a second end;

a first coupling, the first coupling connecting the first end of the receptacle structure to the first clutch structure and the second coupling connecting the second end of the receptacle structure to the second clutch structure;

wherein the first clutch structure prevents the first coupling from loosening the receptacle structure and the second clutch structure prevents the second coupling from loosening the second clutch structure.

10. The connector of claim 9, wherein the first clutch structure includes a first surface opposing the first end of the receptacle structure, a second surface extending lengthwise at ninety-degrees from the first surface, and a slot formed to extend lengthwise for receiving the first coupling.

11. The connector of claim 9, wherein the second clutch structure includes a first surface opposing the second end of the receptacle structure, a second surface extending lengthwise at ninety-degrees from the first surface, and a slot formed to extend lengthwise for receiving the second coupling.

12. The connector of claim 10, wherein the first end of the receptacle structure is rounded to facilitate pivoting on the platform.

13. The connector of claim 11, wherein the first coupling fits into the first end of the receptacle structure so as to bias the receptacle structure when the receptacle structure is in a raised position.

14. The connector of claim 13, wherein the second coupling fits into the second end of the receptacle structure so as to bias the receptacle structure when the receptacle structure is in the raised position.

15. The connector of claim 11, wherein the first coupling fits into the first end of the receptacle structure so as to bias the receptacle structure when the receptacle structure is in a lowered position.

* * * * *